US005628675A

United States Patent [19]

Brown et al.

[11] Patent Number: 5,628,675

[45] Date of Patent: May 13, 1997

[54] PIPE END BEVELING APPARATUS

[76] Inventors: Terry S. Brown, 1216 Cedar Tree La., Seffner, Fla. 33584; Donald A. Nicholson, 1216 Cedar Tree La., Tarpon Springs, Fla. 34689

[21] Appl. No.: 546,784

[22] Filed: Oct. 23, 1995

[51] Int. Cl.[6] ..... B24B 1/00

[52] U.S. Cl. ..... 451/49; 451/51; 451/194; 451/358; 451/282

[58] Field of Search ..... 451/358, 344, 451/194, 209, 232, 241, 210, 51, 49, 44, 190, 324, 913, 391, 403, 457, 408, 460, 414, 424, 428, 61, 262, 267, 278, 282; 269/296, 298, 300, 301, 303, 304

[56] References Cited

U.S. PATENT DOCUMENTS

| | | | |
|---|---|---|---|
| 2,909,011 | 10/1959 | Hendricks et al. | 451/358 |
| 3,596,411 | 8/1971 | Hutchins | 451/358 |
| 3,621,505 | 11/1971 | Vocker et al. | 451/194 |
| 3,852,917 | 12/1974 | McKown | 451/51 |
| 4,217,733 | 8/1980 | Van Sickle | 451/49 |
| 5,148,587 | 9/1992 | Phelps et al. | 451/282 |
| 5,251,407 | 10/1993 | Afshar | 451/358 |

*Primary Examiner*—Robert A. Rose
*Assistant Examiner*—George Nguyen
*Attorney, Agent, or Firm*—American Innovations, Inc.; Dorothy S. Morse, Esq.

[57] ABSTRACT

A pipe end trimming device for hand-held use in beveling the outer surface of the end of one pipe so that the beveled end may fit within the end of a similar diameter pipe for a strong connection therebetween. The preferred embodiment abrasive cylinders which are motor driven. An aligning arm with an adjustable aligning edge allows for quick, uniform beveling of different diameter pipe. Shielding adjacent to the abrasive cylinders protects the operator from debris thrown from the pipe during the beveling process.

7 Claims, 3 Drawing Sheets

Figure 1
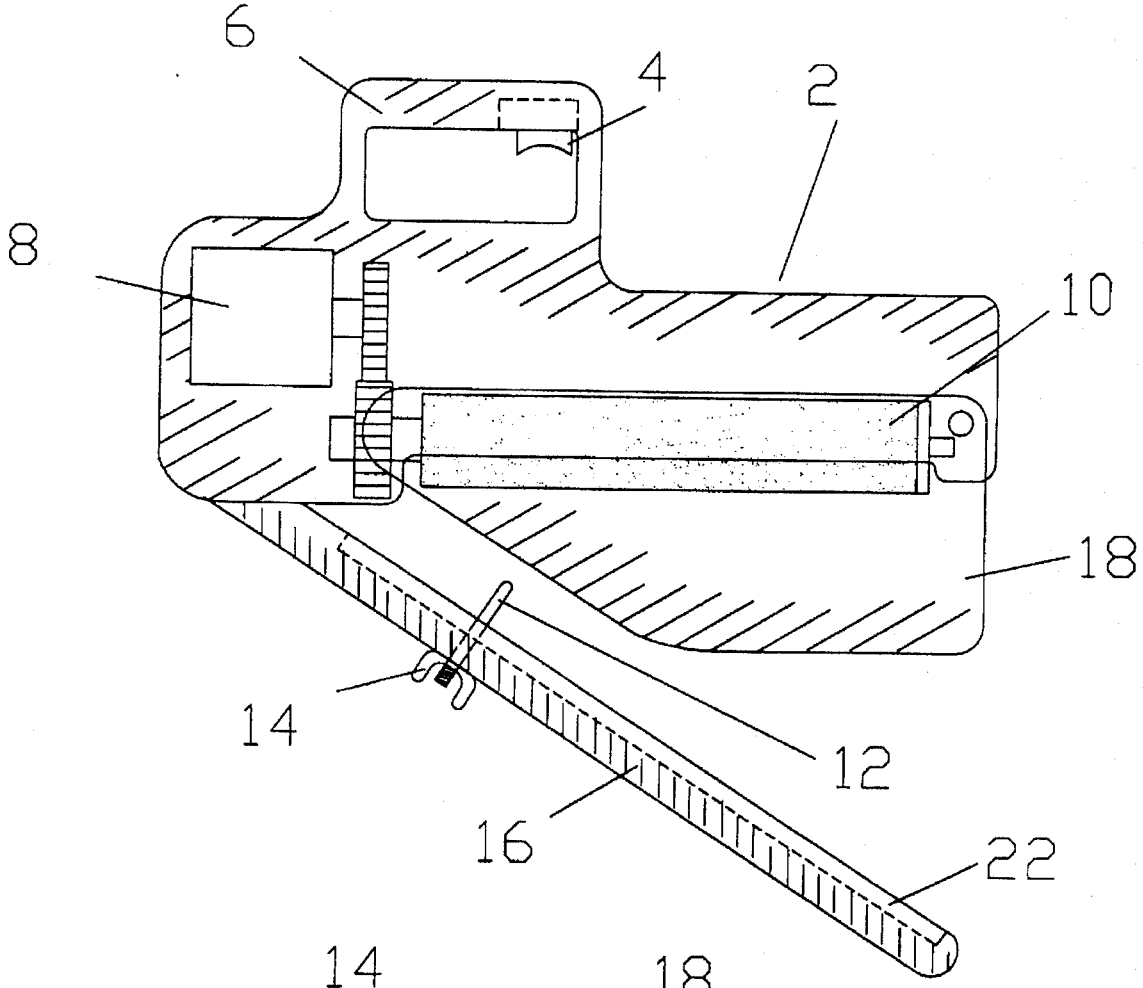
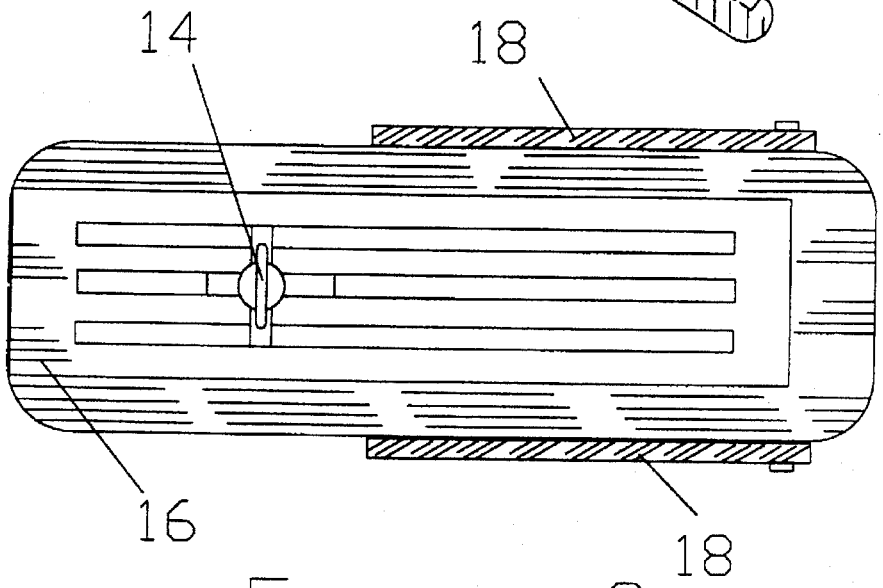
Figure 2

Figure 6
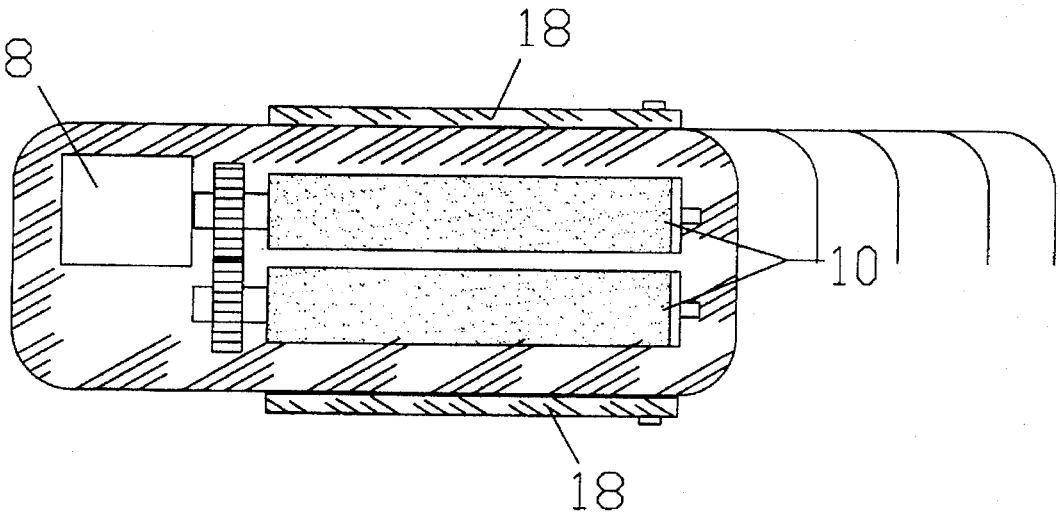
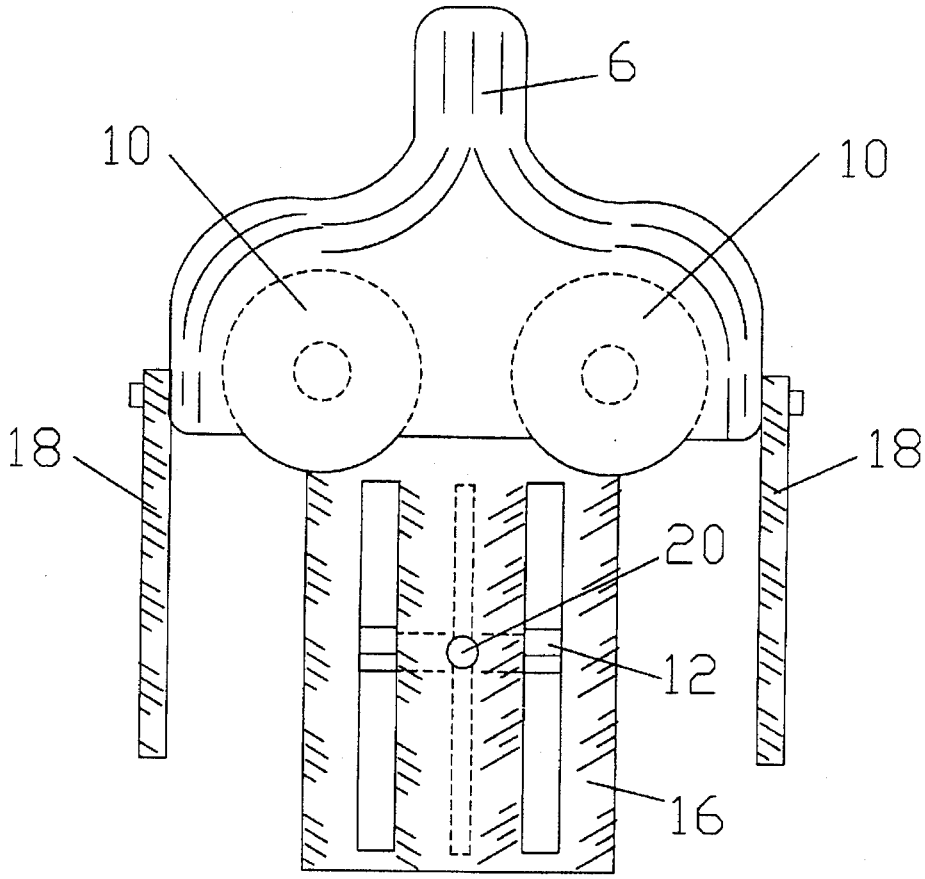
Figure 7

PIPE END BEVELING APPARATUS

BACKGROUND—FIELD OF INVENTION

This invention relates to pipe trimming apparatus, specifically to a hand-held apparatus used for beveling the end of a pipe having a housing in which a plurality of motor-driven abrasive cylinders are positioned for rotation, an aligning arm at a fixed angle relative to the abrasive cylinders with an essentially U-shaped alignment edge movably attached thereto for alignment of the abrasive cylinders with respect to the pipe during hand rotation of the cylinders and housing around the pipe for removal of a desired amount of material from the end of the pipe in beveling its end, the apparatus also having a pair of shields positioned laterally to and downwardly from the abrasive cylinders which together with the downwardly angled aligning arm directs debris from the beveled pipe away from a user.

BACKGROUND—DESCRIPTION OF PRIOR ART

End-to-end connection between two pipes of similar diameter is made stronger by beveling the end of one pipe and inserting the beveled end into the end of an adjacent pipe. Beveling of a spigot also improves a bell-spigot connection having a gasket, as beveling allows for a more uniform seating of the spigot against the gasket. The use of connector pieces each having a diameter slightly larger than the diameter of the pipe requiring connection, also provide a strong end-to-end connection between pipes. However, connector pieces add expense to a project.

The beveling of pipe ends is known to be accomplished with hand-held saws. However, the results can be nonuniform and time consuming, varying with the experience of the saw operator, with the more uniform beveling creating stronger connections between adjacent pipes. A further disadvantage beveling pipe ends with hand-held saws is the safety hazard to which the saw operator is subjected. Pipe debris can be thrown back at the operator in violation of Occupational Safety and Health Administration (OSHA) regulations.

It is not known in this field to have a pipe beveling apparatus which uniformly bevels the end of a pipe and also directs the debris cut from the pipe away from the operator.

SUMMARY OF INVENTION—OBJECTS AND ADVANTAGES

It is the primary object of this invention to provide a pipe end beveling apparatus which uniformly bevels the end of a pipe. It is a further object of this invention to provide a pipe end beveling machine which directs debris cut from the pipe away from the operator. It is also an object of this invention that the pipe end beveling machine be adjustable. It is a further object of this invention to provide a pipe end beveling machine which uniformly bevels the ends of pipe faster than prior art means of beveling pipe.

As described herein, properly manufactured and used to bevel the end of pipes, the present invention would provide a means for achieving uniform beveling results. Since the present invention is adjustable so that different amounts of outer pipe wall can be removed, for different sizes of pipe. Importantly, the present invention would direct debris cut away from the pipe away from the operator and comply with applicable Occupational Safety and Health Administration (OSHA) regulations. Also, index marks on the aligning arm of the present invention would provide a measuring tool for the operator to set the aligning edge at predetermined positions for faster beveling of different sizes of pipe.

The description herein provides preferred embodiments of the present invention but should not be construed as limiting the scope of the pipe end beveling apparatus. Variations in size and composition of the abrasive cylinders, the length and shape of the aligning arm, the size and position of the handle, and the specifications for the motor, other than those shown, can be incorporated into the present invention. Thus the scope of the present invention should be determined by the appended claims and their legal equivalents, rather than the examples given.

BRIEF DESCRIPTION OF THE DRAWINGS

FIG. 1 is a right side view of the internal components of the present invention.

FIG. 2 is a bottom view of the present invention.

FIG. 6 is a bottom view of the present invention without the aligning arm.

FIG. 7 is a front view of the present invention.

DETAILED DESCRIPTION OF PREFERRED EMBODIMENTS

Figure 3:
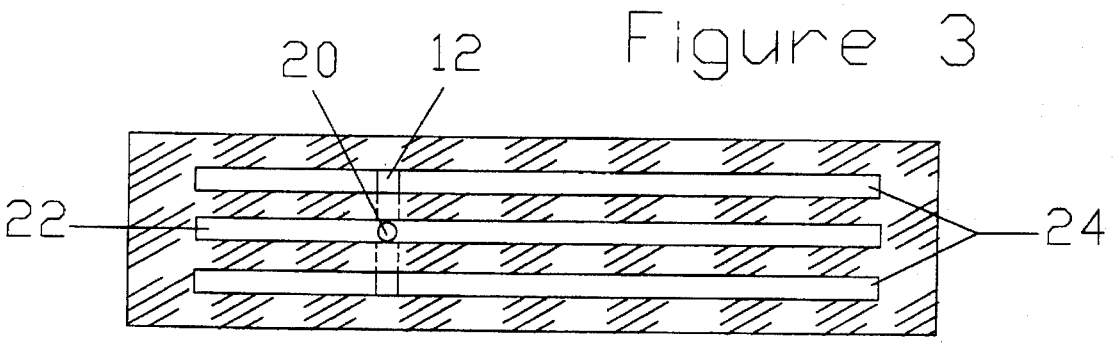
FIG. 3 is a top view of the aligning arm.

FIG. 1 shows a preferred embodiment of a pipe end beveling machine 2 having an abrasive cylinder 10 operationally connected to a motor 8. Abrasive cylinder is exposed through an opening in the lower surface of the hollow housing of pipe end beveling machine 2. Although motor 8 could be gas-driven or electric powered, it is preferred that motor 8 be gas-driven. Positioned below abrasive cylinder 10 is an aligning arm 16. Connected to the surface of aligning arm 16 which faces abrasive cylinder 10 is an alignment edge 12, A wing nut 14 helps to secure alignment edge 12 to aligning arm 16. FIG. 1 also shows pipe end beveling machine 2 having a safety shield 18 positioned adjacent to abrasive cylinder 10, as well as a handle 6 and an on/off switch 4 positioned on the underside of handle 6.

FIG. 2 shows the bottom surface of aligning arm 16 with wing nut 14 positioned thereon. Safety shields 18 are shown on both sides of aligning arm 16.

Figure 4:
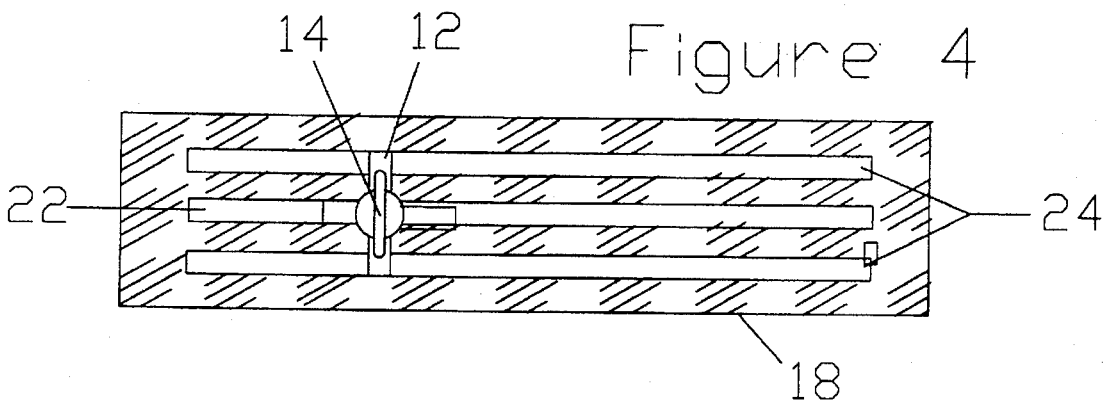
FIG. 4 is a bottom view of the aligning arm showing the placement of index marks.
Figure 5:
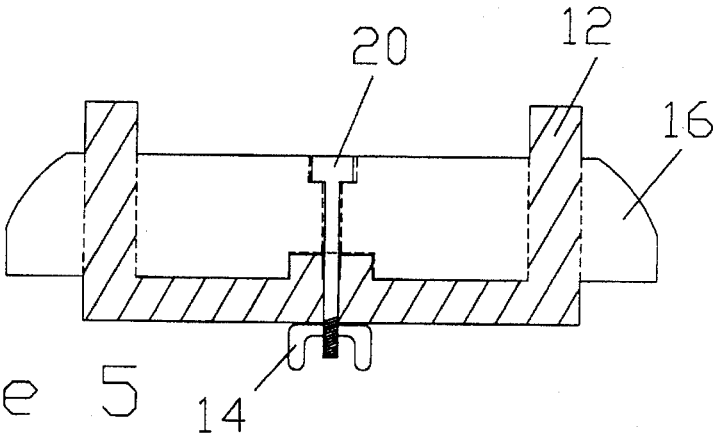
FIG. 5 is a sectional end view of the aligning arm.

FIGS. 3, 4 and 5 show, respectively, a top, bottom and sectional end view of aligning arm 16. FIG. 3 shows a locking bolt 20 securing alignment edge 12 to the top surface of aligning arm 16 along center ridge 22. FIG. 3 also shows a center ridge 22 for attachment of locking bolt 20 and a pair of slots 24, one on either side of center ridge 22 for insertion therethrough of the distal portions of alignment edge 12. In addition, FIG. 4 shows wing nut 14 connected to alignment edge 12 and index marks 26 used for determining the amount of material removed from the outer surfaces of different sizes of pipe (not shown).

FIGS. 6 and 7 show a pair of abrasive cylinders 10 adjacent to one another and operationally connected to one another for rotation. One abrasive cylinder 10 is directly connected to motor 8. Safety shields are also shown on either side of connected abrasive cylinders 10.

To use the preferred embodiment of pipe end beveling machine 2, the operator must first unscrew wing nut 14 from locking bolt 20 to unlock alignment edge 12 and position it along aligning arm 16 so that the desired amount of outer surface will be pipe material removed from the beveled end of the pipe. Index marks 26 can be used to position alignment edge 12 in a desired location along aligning arm 16 for repetitive beveling operations. Alignment edge 12 can then secured with locking bolt 20 and wing nut 14 against center ridge 22 of aligning arm 16 in the preferred position. On/off switch 4 can then used to start motor 8, which causes each abrasive cylinder 10 to rotate about it axis. The operator can then pick up pipe end beveling machine 2, position an end of a pipe (not shown) against aligning arm 16, between slots 24 and then using handle 6, manually rotate pipe end beveling machine 2 around the end of the pipe (not shown) to safely, quickly and uniformly bevel the end of the pipe (not shown) while debris removed from the pipe (not shown) is channeled between safety shields 18 and aligning arm 16 away from the operator. When the end the pipe (not shown) can be positioned against alignment edge 12, the desired amount of material has been removed from the outside surface of the pipe.

In the preferred embodiment, it is contemplated for pipe end beveling machine 2 to be used for beveling the ends of polyvinyl chloride (PVC) pipe. However, pipe end beveling machine 2 could be used in the beveling of the ends of other types of pipe. Abrasive material appropriate for the grinding of polyvinyl chloride (PVC) pipe would be applied to the outside surface of cylinders 10 in the preferred embodiment. However, it is contemplated that other abrasive material could also be applied to cylinders 10 for use in beveling other types of pipe.

What is claimed is:

1. A pipe beveling device for abrading the outer surface of an end of a pipe, said pipe beveling device comprising a housing having a hollow interior, a lower surface, and an opening through its lower surface; a motor positioned within said housing; at least two rotatable abrasive cylinders positioned within said housing and exposed through said lower surface, said abrasive cylinders interconnected for rotation with at least one of said abrasive cylinders connected to and driven by said motor, said abrasive cylinders also having opposite ends, an aligning arm against which said outer surface of said pipe may he held during said abrading of said outer surface of said end of said pipe, said aligning arm having opposite ends and one of said opposite ends being connected to said lower surface of said housing near to one of said opposite ends of said abrasive cylinders, and a pair of safety shields attached to said housing adjacent to said opening in said lower surface of said housing so that in combination with said aligning arm said safety shields direct material removed from said pipe during said abrading away from a person using said pipe beveling device.

2. The pipe beveling device of claim 1 further comprising an adjustable alignment edge for positioning said outer surface of said end of said pipe between said aligning arm and said abrasive cylinders and defining the forwardmost movement of said pipe between said aligning arm and said abrasive cylinders, said adjustable aligning edge being attached to said aligning arm with a wing nut and a bolt.

3. The pipe beveling device of claim 2 wherein said aligning arm comprises a pair of slots therethrough, said alignment edge being positioned through said slots when engaged with said outer surface of said end of said pipe during use.

4. The pipe beveling device of claim 3 further comprising a plurality of index marks to use in positioning said alignment edge along said aligning arm for contacting said end of said pipe when said end of said pipe is in the appropriate position for said desired amount of said material to be removed from said end of said pipe during said abrading.

5. The pipe beveling device of claim 4 further comprising a handle attached to said housing and an on/off switch attached to said handle for said engagement and disengagement of said motor.

6. A method for beveling the outer surface of the end of a pipe comprising the steps of providing an end of a pipe and a pipe end beveling device having a wing nut, a locking bolt, an adjustable alignment edge, two slots, an aligning arm, an on/off switch, a handle, a motor, a plurality of abrasive cylinders, and a plurality of safety shields; unscrewing said wing nut from said locking bolt to unlock said alignment edge; positioning said alignment edge along said slots in said aligning arm into a preferred position for removal of a desired amount of material from said end of the pipe; securing said alignment edge with said locking bolt and said wing nut against said aligning arm in said preferred position; using said on/off to start said motor which causes each of said abrasive cylinders to rotate about its axis; picking up said pipe end beveling device and positioning said end of said pipe between said abrasive cylinders and said aligning arm; while holding said pipe against said abrasive cylinders and said aligning arm, using said handle to manually rotate said pipe end beveling device around said end of said pipe to safely, quickly and uniformly bevel said end of said pipe while debris removed from said end of said pipe is channeled between said safety shields and said aligning arm away from an operator, said desired amount of said material being removed from said pipe when forward movement of said end of said pipe between said aligning arm and said abrasive cylinders is prevented by said aligmnent edge.

7. The method of claim 6 further comprising the step of providing a plurality of index marks on said aligning arm and the step of using said index marks for positioning said alignment edge along said aligning arm into said preferred position for removing said desired amount of said material from said end of said pipe during said beveling step.

* * * * *